US008950228B2

(12) United States Patent
Lee et al.

(10) Patent No.: US 8,950,228 B2
(45) Date of Patent: Feb. 10, 2015

(54) BENDING PRESS SYSTEM

(75) Inventors: Mun Yong Lee, Busan (KR); Sang Jin Ha, Busan (KR)

(73) Assignee: Sungwoo Hitech Co., Ltd., Busan (KR)

( * ) Notice: Subject to any disclaimer, the term of this patent is extended or adjusted under 35 U.S.C. 154(b) by 299 days.

(21) Appl. No.: 13/517,797

(22) Filed: Jun. 14, 2012

(65) Prior Publication Data

US 2013/0255349 A1 Oct. 3, 2013

(30) Foreign Application Priority Data

Mar. 28, 2012 (KR) ..... 10-2012-0031432

(51) Int. Cl.
*B21D 11/00* (2006.01)

(52) U.S. Cl.
USPC ..... 72/296; 72/305; 72/389.6

(58) Field of Classification Search
USPC ..... 72/386, 389.1, 389.2, 420, 421, 57, 72/296, 305, 306, 311, 312, 389.6
See application file for complete search history.

(56) References Cited

U.S. PATENT DOCUMENTS 3,603,128 A * 9/1971 Middleton ..... 72/58

FOREIGN PATENT DOCUMENTS

| | | |
|---|---|---|
| CN | 201552217 | 8/2010 |
| CN | 202079134 | 12/2011 |
| JP | 06-047453 | 2/1994 |
| JP | 06-142805 | 5/1994 |
| JP | 2006-116595 | 5/2006 |

* cited by examiner

*Primary Examiner* — Debra Sullivan
(74) *Attorney, Agent, or Firm* — Lexyoume IP Meister, PLLC

(57) ABSTRACT

A bending press system is disclosed. The bending press system may include: at least one guide post; a slide plate mounted at a slider so as to be slidable upwardly or downwardly along the guide post; a bending die including a lower die having an upper surface and an upper die having a lower surface corresponding to the upper surface of the lower die and mounted on a lower surface of the slide plate, and adapted to bend an object supplied between the lower die and the upper die to have a predetermined curvature; and a pair of clamping means mounted respectively at both sides of the bending die corresponding to the bending die and adapted to clamp both end portions of the object.

8 Claims, 7 Drawing Sheets

BENDING PRESS SYSTEM

CROSS-REFERENCE TO RELATED APPLICATION

This application claims priority to and the benefit of Korean Patent Application No. 10-2012-0031432 filed in the Korean Intellectual Property Office on Mar. 28, 2012, the entire contents of which are incorporated herein by reference.

BACKGROUND OF THE INVENTION (a) Field of the Invention

The present invention relates to a bending press system. More particularly, the present invention relates to a bending press system that is adapted to form a pipe to have a predetermined curvature in a state that both ends of the pipe manufactured through extrusion are clamped.

(b) Description of the Related Art

Generally, stretch bend forming or roll bend forming is used to form a bumper beam for a vehicle to have a predetermined curvature when a pipe manufactured through extrusion is used.

According to the stretch bend forming, after both ends of the metal pipe are fixed and a middle portion of the metal pipe is contacted to a die having a predetermined curvature, force toward the die is applied to the both ends of the metal pipe so as to bend the metal pipe to have a predetermined curvature.

According to roll bend forming, if the metal pipe is supplied to a plurality of bending rolls that are disposed along a predetermined curvature and are rotated, the metal pipe is formed to have a predetermined curvature when passing through the plurality of bending rolls.

Since a number of processes should be gone through so as to manufacture a product according to stretch bend forming, productivity may be low. Since material is not deformed to yield point of the material according to roll bend forming, it is difficult to form a desired curvature due to spring back.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a bending press system having advantages of preventing spring back and deforming a pipe plastically by deforming a local part of the pipe to yield point through pressing in a state of supplying the pipe to the bending die and clamping both ends of the pipe. Therefore, quick formability and reasonable bending quality may be secured.

Another embodiment of the present invention provides a bending press system having advantages of shortening manufacturing cycle time and enabling of mass production by forming a curvature through pressing.

A bending press system according to an exemplary embodiment of the present invention may include: at least one guide post; a slide plate mounted at a slider so as to be slidable upwardly or downwardly along the guide post; a bending die including a lower die having an upper surface and an upper die having a lower surface corresponding to the upper surface of the lower die and mounted on a lower surface of the slide plate, and adapted to bend an object supplied between the lower die and the upper die to have a predetermined curvature; and a pair of clamping means mounted respectively at both sides of the bending die corresponding to the bending die and adapted to clamp both end portions of the object.

A lower curvature forming surface having a predetermined curvature along a length direction may be formed at a middle portion of the upper surface of the lower die, and an upper curvature forming surface having a predetermined curvature along a length direction corresponding to the lower curvature forming surface may be formed at the lower surface of the upper die.

The bending die may further include at least one lifting die disposed so as to contact with at least one side surface of the lower die, supported upwardly by a spring, and adapted to push upwardly at least one end portion of the object on which bend forming is completely performed.

A supporting surface connectable to the upper curvature forming surface may be formed at a middle portion of an upper surface of the lifting die.

The clamping means may include: a clamping block provided with a space formed therein and a slot formed at a surface thereof along a length direction of the bending die; an insert cylinder mounted at an outer surface of the clamping block in the length direction of the bending die and having an operating rod; a clamping jaw disposed in the space of the clamping block, connected to the operating rod of the insert cylinder, and having an inner end portion at which a receiving recess for receiving an end portion of the object is formed and an outer end portion connected to the slot through a slot pin; a clamping cylinder mounted corresponding to the receiving recess at an upper end of the clamping jaw through a bracket and having an operating rod; and a clamper disposed in the receiving recess and connected to the operating rod of the clamping cylinder so as to be movable in a vertical direction.

A guide post for guiding upward or downward movement of the slide plate may be mounted at an upper surface of the clamping block.

The clamping cylinder may be a hydraulic cylinder or a pneumatic cylinder.

The insert cylinder may be a hydraulic cylinder or a pneumatic cylinder.

The object may be an aluminum pipe made through extrusion.

DESCRIPTION OF SYMBOLS

| | |
|---|---|
| 1: base | 3: slide plate |
| 5: bending die | 7: clamping means |
| 9: slider | 11: guide post |
| 13: lower die | 15: upper die |
| 17: lifting die | 21: clamping block |
| 21a: slot | 23: insert cylinder |
| 25: clamping jaw | 25a: slot pin |
| 25b: receiving recess | 27: clamping cylinder |
| 29: clamper | |

DETAILED DESCRIPTION OF THE EMBODIMENTS

An exemplary embodiment of the present invention will hereinafter be described in detail with reference to the accompanying drawings.

Figure 1:
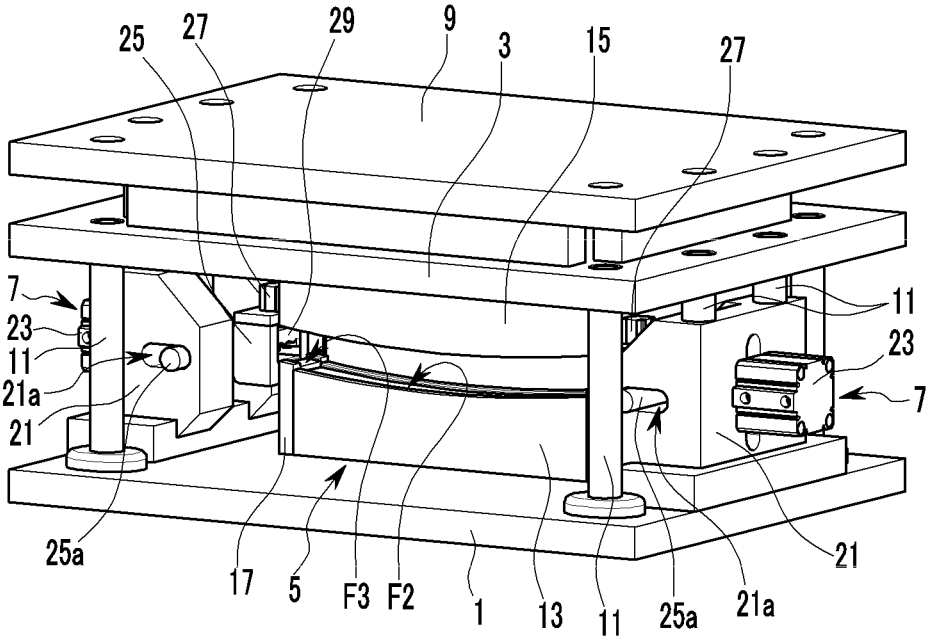
FIG. 1 is a perspective view of a bending press system according to an exemplary embodiment of the present invention.
Figure 2:
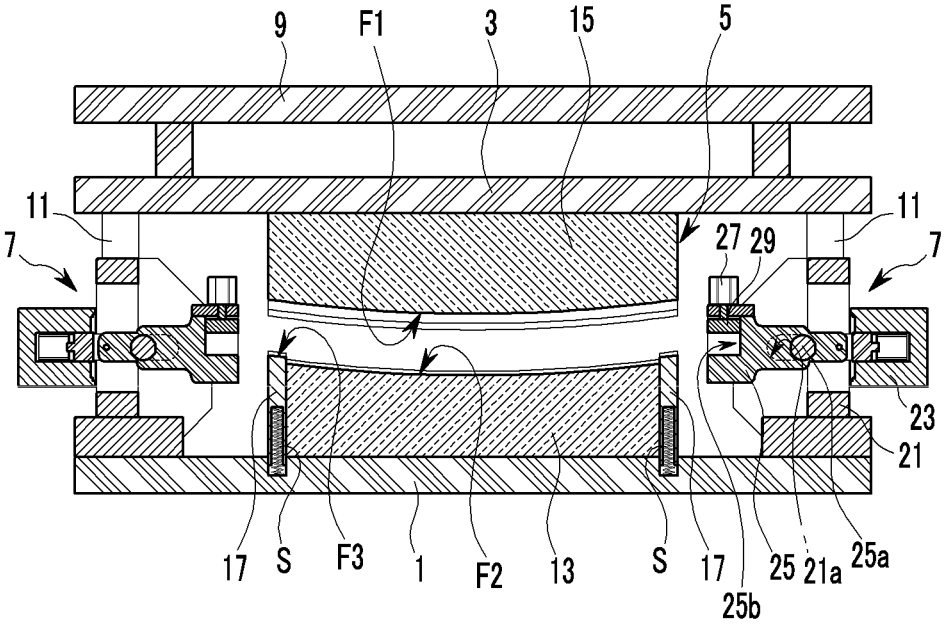
FIG. 2 is a cross-sectional view of a bending press system according to an exemplary embodiment of the present invention.

FIG. 1 is a perspective view of a bending press system according to an exemplary embodiment of the present invention, and FIG. 2 is a cross-sectional view of a bending press system according to an exemplary embodiment of the present invention.

Referring to FIG. 1, a bending press system according to an exemplary embodiment of the present invention includes a base 1, a slide plate 3, a bending die 5 and clamping means 7.

The base 1 is mounted on a floor of a workroom, and guide posts 11 are mounted at corner portions of the base 1.

The slide plate 3 is adapted to be movable upwardly or downwardly along four guide posts 11 mounted on the base 1. A slider 9 is mounted on an upper surface of the slide plate 3.

The bending die 5 includes a lower die 13 mounted at a center portion on the base 1 and an upper die 15 having a lower surface corresponding to an upper surface of the lower die 13 and mounted on a center portion of a lower surface of the slide plate 3. The bending die 5 is adapted to bend an object supplied between the lower die 13 and the upper die 15 to have a predetermined curvature.

Referring to FIG. 2, the lower die 13 is mounted on the center portion of the base 1, and a lower curvature forming surface F1 having a predetermined curvature along a length direction is formed on a middle portion of the upper surface of the lower die 13. The lower curvature forming surface F1 is formed as a groove type and the object is inserted in the groove.

In addition, the upper die 15 is mounted on the center portion of the lower surface of the slide plate 3, and an upper curvature forming surface F2 corresponding to the lower curvature forming surface F1 and having a predetermined curvature along a length direction is formed on a middle portion of the lower surface of the upper die 15. The upper curvature forming surface F2 is formed as a groove type and the object is inserted in the groove.

The bending die 5 further includes at least one lifting die 17. The lifting die 17 is disposed so as to contact with a side surface or both side surfaces of the lower die 13. The lifting die 17 is mounted on the base 1 through a spring S, and the spring S supports the lifting die 17 upwardly.

The lifting die 17 pushes upwardly an end portion or both end portions of the object on which bend forming is completely performed so as to extract the object from the lower die 13.

A supporting surface F3 connectable to the upper curvature forming surface F2 is formed at a middle portion of an upper surface of the lifting die 17. The supporting surface F3 is formed as a groove type and each of both end portions of the object is inserted in the groove.

The pair of clamping means 7 is respectively mounted at both sides on the base 1 corresponding to the bending die 5, and is adapted to clamp both end portions of the object.

The clamping means 7 includes a clamping block 21, an insert cylinder 23, a clamping jaw 25, a clamping cylinder 27 and a clamper 29.

The clamping block 21 is fixedly mounted on the base 1, and is provided with a space formed therein and a slot 21*a* formed at a surface thereof along a length direction of the bending die 5.

In addition, two guide posts 11 for guiding upward or downward movement of the slide plate 3 are mounted on an upper surface of the clamping block 21.

The insert cylinder 23 is mounted at another surface (outer surface) of the clamping block 21 in the length direction of the bending die 5.

Herein, an outer side or an outer surface means a side or a surface farthest from the bending die 5 in each constituent element of the clamping means 7, and an inner side or an inner surface means a side or a surface closest to the bending die 5 in each constituent element of the clamping means 7.

Meanwhile, the insert cylinder 23 may be a hydraulic cylinder operated by hydraulic pressure or a pneumatic cylinder operated by pneumatic pressure.

The clamping jaw 25 is disposed in the space of the clamping block 21 and is connected to an operating rod of the insert cylinder 23. A receiving recess 25*b* for receiving an end portion of the object is formed at an inner end portion of the clamping jaw 25, and an outer end portion of the clamping jaw 25 is connected to the slot 21*a* through a slot pin 25*a*.

The clamping cylinder 27 is mounted corresponding to the receiving recess 25*b* at an upper end of the clamping jaw 25 through a bracket.

In addition, the clamper 29 is positioned in the receiving recess 25*b* and is connected to the operating rod of the clamping cylinder 27 so as to be movable in a vertical direction.

The clamping cylinder 27 may be a hydraulic cylinder operated by hydraulic pressure or a pneumatic cylinder operated by pneumatic pressure.

Hereinafter, operation of the bending press system according to an exemplary embodiment of the present invention will be described in detail with reference to FIG. 3 to FIG. 7.

For convenience of description, an aluminum pipe manufactured through extrusion is exemplified as the object 30 in this specification and the drawings, but the object 30 is not limited to the aluminum pipe.

Figure 3:
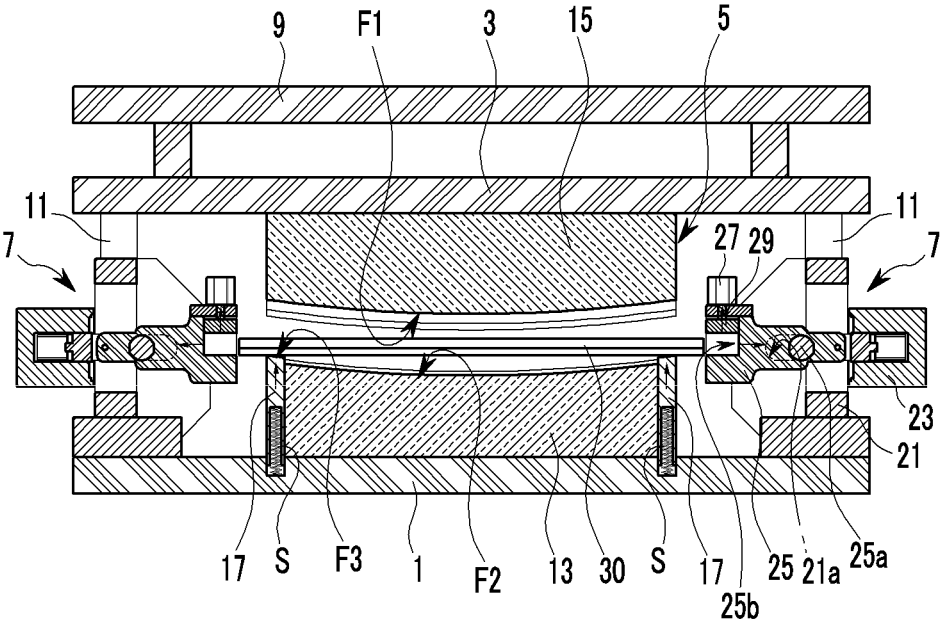
FIG. 3 to FIG. 7 are cross-sectional views for illustrating operation of a bending press system according to an exemplary embodiment of the present invention.

Referring to FIG. 3, in a state that the upper die 15 mounted at the slide plate 3 is disposed apart from the lower die 13, the object 30 is supplied between the upper die 15 and the lower die 13. At this time, both end portions of the object 30 are put on the lifting dies 17.

Figure 4:
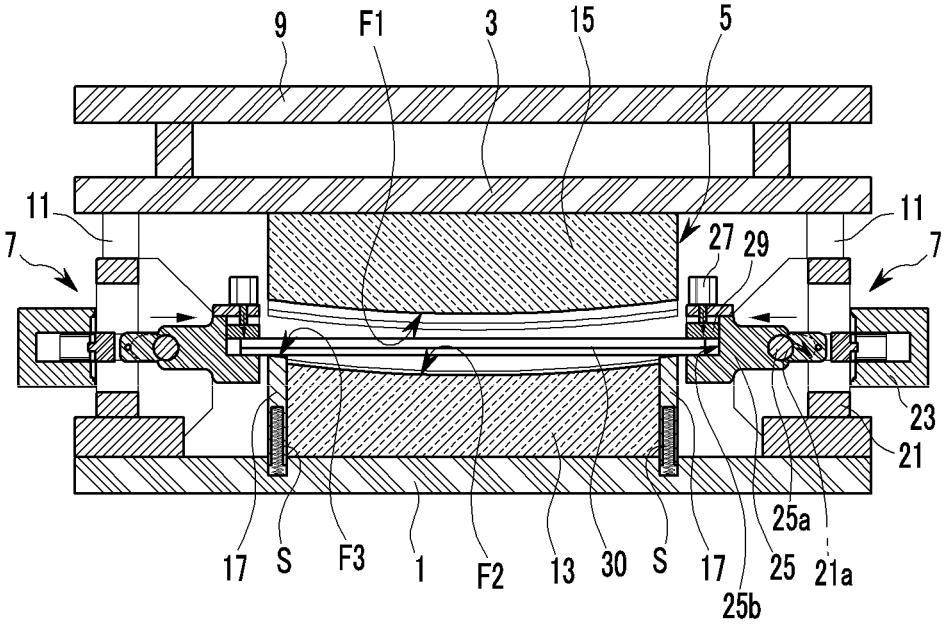

At this state, as shown in FIG. 4, the insert cylinder 23 of the clamping means 7 moves forward such that both end portions of the object 30 are respectively inserted into the receiving recesses 25*b* of the clamping jaw 25. After that, the clamping cylinder 27 moves forward such that the clamper 29 exerts force on the object 30 toward the clamping jaw 25 and both end portions of the object 30 are clamped.

Figure 5:
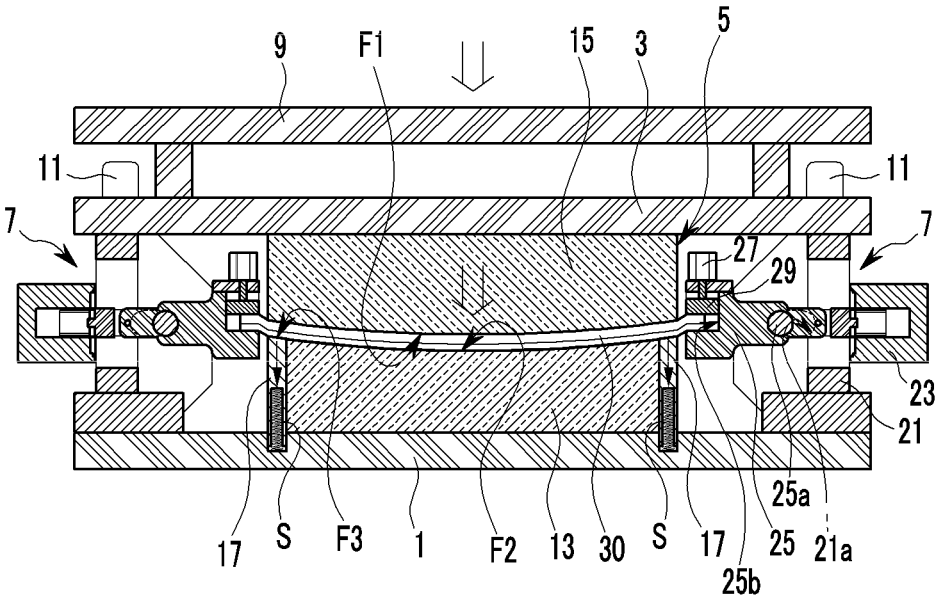

After that, if the slider 9 moves downwardly and the upper die 15 and the lower die 13 are joined together as shown in FIG. 5, the object 30, with both ends thereof being clamped by the clamping means 7, is plastically deformed along the lower curvature forming surface F1 of the upper die 15 and the upper curvature forming surface F2 of the lower die 13. Therefore, the object 30 is formed to have a predetermined curvature.

Figure 6:
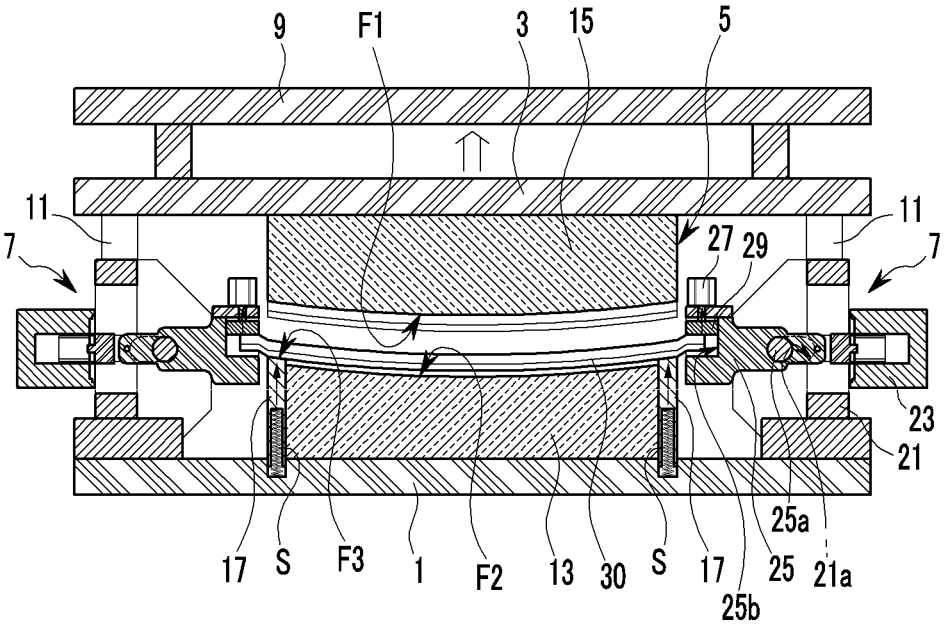

After that, the slider 9 moves upwardly and the upper die 15 is separated from the lower die 13, as shown in FIG. 6. In addition, the clamping cylinder 27 moves rearward and clamping force that was exerted on both end portions of the object 30 is released.

In addition, when the clamping cylinder 27 moves rearward, the lifting dies 17 push both end portions of the object 30 upwardly so as to extract the object 30 from the lower die 13.

Figure 7:
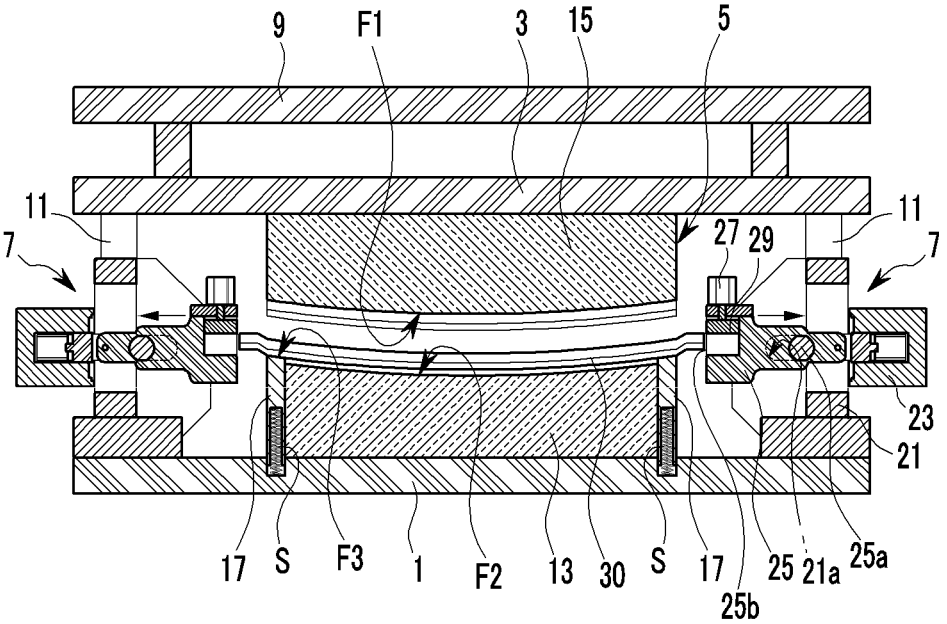

After that, the insert cylinders 23 move rearward and both end portions of the object 30 are escaped completely from the receiving recesses 25*b* of the clamping jaws 25, as shown in FIG. 7. Therefore, the object 30 can be extracted.

According to an exemplary embodiment of the present invention, in a state of clamping both end portions of the pipe in the bending die, only a local part of the pipe is deformed to yield point through pressing. Therefore, spring back may be prevented and the pipe may be plastically deformed stably.

In addition, since a curvature is formed through pressing, quick formability and reasonable bending quality may be secured. In addition, mass production may be possible by shortening manufacturing cycle time.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A bending press system, comprising:

at least one guide post;

a slide plate mounted at a slider so as to be slidable upwardly or downwardly along the guide post;

a bending die including a lower die having an upper surface and an upper die having a lower surface corresponding to the upper surface of the lower die and mounted on a lower surface of the slide plate, and adapted to bend an object supplied between the lower die and the upper die to have a predetermined curvature; and a pair of clamping means mounted respectively at both sides of the bending die corresponding to the bending die and adapted to clamp both end portions of the object, wherein the clamping means comprise:

a clamping block provided with a space formed therein and a slot formed at a surface thereof along a length direction of the bending die;

an insert cylinder mounted at an outer surface of the clamping block in the length direction of the bending die and having an operating rod;

a clamping jaw disposed in the space of the clamping block, connected to the operating rod of the insert cylinder, and having an inner end portion at which a receiving recess for receiving an end portion of the object is formed and an outer end portion connected to the slot through a slot pin;

a clamping cylinder mounted corresponding to the receiving recess at an upper end of the clamping jaw through a bracket and having an operating rod; and a clamper disposed in the receiving recess and connected to the operating rod of the clamping cylinder so as to be movable in a vertical direction.

2. The bending press system of claim 1, wherein a lower curvature forming surface having a predetermined curvature along a length direction is formed at a middle portion of the upper surface of the lower die, and an upper curvature forming surface having a predetermined curvature along a length direction corresponding to the lower curvature forming surface is formed at the lower surface of the upper die.

3. The bending press system of claim 2, wherein the bending die further comprises at least one lifting die disposed so as to contact with at least one side surface of the lower die, supported upwardly by a spring, and adapted to push upwardly at least one end portion of the object on which bend forming is completely performed.

4. The bending press system of claim 3, wherein a supporting surface connectable to the upper curvature forming surface is formed at a middle portion of an upper surface of the lifting die.

5. The bending press system of claim 1, wherein an additional at least one guide post for guiding upward or downward movement of the slide plate is mounted at an upper surface of the clamping block.

6. The bending press system of claim 1, wherein the clamping cylinder is a hydraulic cylinder or a pneumatic cylinder.

7. The bending press system of claim 1, wherein the insert cylinder is a hydraulic cylinder or a pneumatic cylinder.

8. The bending press system of claim 1, wherein the object is an aluminum pipe made through extrusion.

* * * * *